US006575093B1

(12) United States Patent
Principe

(10) Patent No.: US 6,575,093 B1
(45) Date of Patent: Jun. 10, 2003

(54) MACHINE FOR PRINTING ON FLAT SUPPORTS

(75) Inventor: Giuseppe Principe, Milan (IT)

(73) Assignee: Siasprint Group S.r.l., Novara (IT)

( * ) Notice: Subject to any disclaimer, the term of this patent is extended or adjusted under 35 U.S.C. 154(b) by 50 days.

(21) Appl. No.: 09/722,953

(22) Filed: Nov. 27, 2000

(30) Foreign Application Priority Data

Dec. 1, 1999 (IT) ..... MI99A2507

(51) Int. Cl.[7] ..... B41F 35/00
(52) U.S. Cl. ..... 101/424.1; 347/102
(58) Field of Search ..... 101/115, 123, 101/424.1; 400/82; 347/37, 39, 101, 102, 104

(56) References Cited

U.S. PATENT DOCUMENTS 3,968,498 A * 7/1976 Uchiyama ..... 118/663
4,813,351 A * 3/1989 Pierson, Jr. ..... 101/115
5,595,118 A * 1/1997 Villaverde et al. ..... 101/424.1
5,966,836 A * 10/1999 Valdez, III et al. ..... 34/448
6,092,890 A * 7/2000 Wen et al. ..... 347/101
6,155,170 A * 12/2000 Benedetto et al. ..... 101/424.1

FOREIGN PATENT DOCUMENTS

| | | |
|---|---|---|
| EP | 0 897 805 A | 2/1999 |
| JP | 59 209148 A | 11/1984 |
| JP | 11 105376 A | 4/1999 |

* cited by examiner

*Primary Examiner*—Ren Yan
(74) *Attorney, Agent, or Firm*—Hedman & Costigan, P.C.

(57) ABSTRACT

A machine for printing on flat supports of a type equipped with one or more printing heads (12) fed by respective ink reservoirs (13), where the printing heads (12) are supported by a device (14) movable in at least two perpendicular directions. In this printing machine (10), the printing heads (12) are associated with at least one ultraviolet lamp (UV) (20, 21) also movable by the device (14).

4 Claims, 2 Drawing Sheets

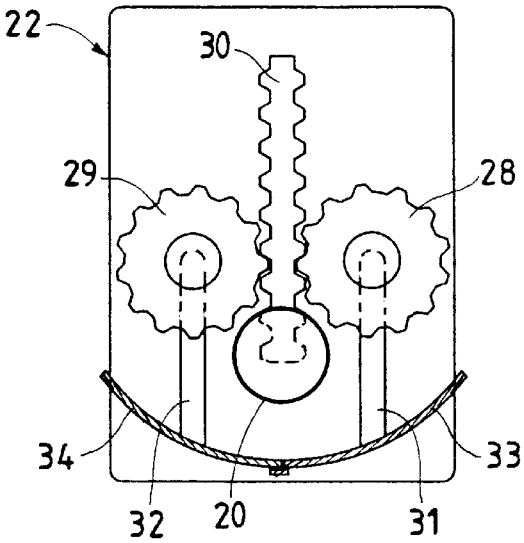
Fig.2
Fig.3
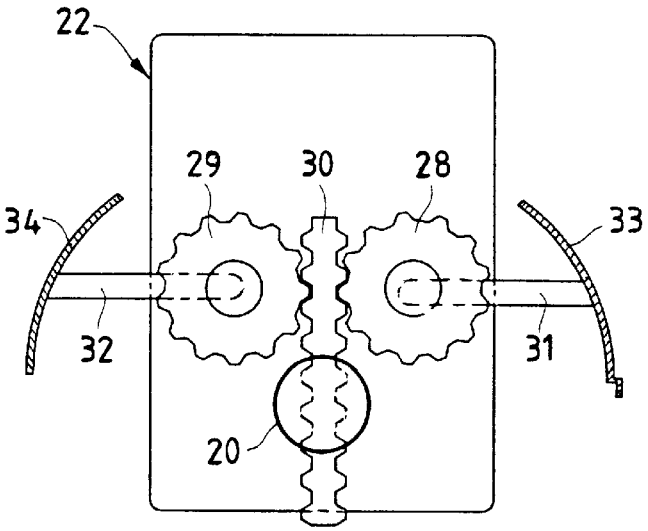

MACHINE FOR PRINTING ON FLAT SUPPORTS

BACKGROUND OF THE INVENTION

The object of this invention is a machine for printing on flat supports. The known machines for printing on flat supports and equipped with a multiple number of printing heads are fed by their respective ink reservoirs and movable in perpendicular directions with respect to the surface to be printed, by using a mobile device.

Such machines generally exhibit a printing head equipped with ink spraying nozzles for various colors, which permit a color printing, especially in a four color process, on a flat support.

The flat printing supports are generally composed of a special paper. The known printing machines must therefore be used by employing special inks, capable of a quick-drying process in contact with the mentioned special paper.

It is in fact important that the ink be capable of drying quickly, so as to ensure a high quality-printing Despite being capable of performing the function they were designed for, the printing machines of the described type suffer from a few notable drawbacks.

In the first place, the use of said special paper as well of the mentioned inks proves to be particularly costly.

In the second place, the need to use a special paper constitutes an important limitation of the possibilities of using the printing machines known to this date.

SUMMARY OF THE INVENTION

The purpose of this invention is therefore to produce a machine for printing on flat supports, capable of printing on the broadest variety of supports. Another purpose of the invention is to produce a machine for printing on flat supports at a low operating cost with respect to that of the printing machines known at this time.

These and other purposes are achieved by a machine for printing on flat supports, of a type equipped with one or more printing heads fed by their respective ink reservoirs, where said printing heads are supported by an equipment arranged in a mobile manner in at least two perpendicular directions, characterized in that said printing heads are associated with at least an ultraviolet lamp (UV), which is also made mobile by the above equipment.

BRIEF DESCRIPTION OF THE DRAWINGS

Additional purposes and advantages of this invention will become clear from the description and enclosed drawings to follow, supplied for purely exemplifying and non-limiting purposes, in which:

FIG. 2 shows a simplified sectional view of the opening mechanism of a box-like body, containing an ultraviolet lamp (UV) and belonging to the printing machine shown in FIG. 1, FIG. 3 shows a simplified sectionalized view of the opening mechanism of FIG. 2, in an open position.

DETAILED DESCRIPTION OF THE INVENTION

Figure 1:
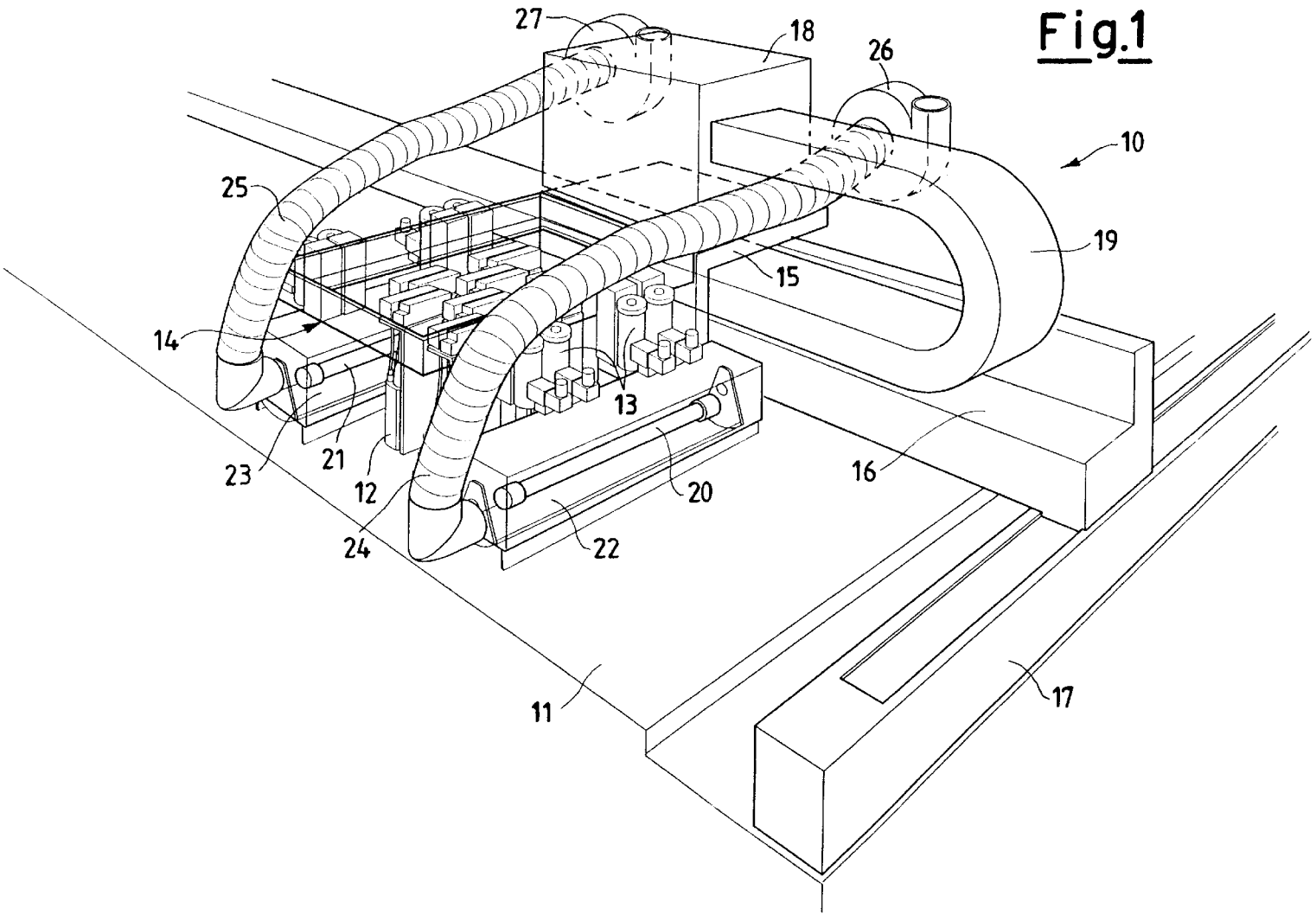
FIG. 1 shows a prospective view of the machine for printing on flat supports, according to this invention.

With particular reference to FIG. 1, the machine for printing on flat supports according to this invention is shown in its overall form by the reference number 10.

The machine 10 is capable of printing on a flat support 11 and equipped with a multiple number of printing heads 12, fed by their respective ink reservoirs 13 and supported by a device 14, which is movable in two perpendicular directions.

Provision is made for a printing head 12 equipped with spraying nozzles for every color to perform a color printing process, especially in four colors.

In particular, the mobile device 14 is fastened to an L-shaped support 15, which is in turn capable of sliding along a first straight rail 16.

The first straight rail 16 actually supports the entire machine 10 and rests in a sliding manner on a pair of guides 17 (only one of which is visible for simplicity in FIG. 1).

The L-shaped support 15 is also firmly associated with a control panel 18 connected to the remainder of the machine 10 by a plastic chain 19, which contains the electrical connecting cables.

The printing heads 12 are flanked by two ultraviolet (UV) lamps, as indicated in FIG. 1 by their respective reference numbers 20 and 21.

The UV lamps 20 and 21 are housed inside box-like bodies 22 and 23, respectively, which are both capable of being opened and closed in their lower portions. In particular, the FIGS. 2–3 offer a simplified view of the opening mechanism in the lower portion of one of the two box-like bodies, especially of the box-like body 22. The second box-like body 23 is fitted with an entirely similar mechanism not shown here.

The mechanism of the FIGS. 2–3 is constituted by a pair of gears 28 and 29, actuated by a double rack 30, each of which carries a lever 31 and 32.

The levers 31 and 32 are connected to pivoting walls 33 and 34.

The box-like bodies 22 and 23 are also connected to flexible tubes 24 and 25, which are in turn receiving air from the fans 26 and 27.

The group composed of the UV lamps 20 and 21 and of their respective box-like bodies 22 and 23, as well as of the flexible tubes 24 and 25 and the fans 26 and 27, is also firmly attached to the machine 10 and moves together with the same.

The operation of the machine 10 for printing on flat supports 11, as an object of this invention, is briefly described as follows.

Thanks to the printing heads 12 fed by the ink reservoirs 13, the printing machine 10 is capable of performing color prints on the flat support 11.

Because the printing heads 12 are supported by the mobile equipment 14, the printing can be performed on the entire useful surface of the flat support.

The presence of the ultraviolet lamps UV 20 and 21 allows creating the appropriate spraying conditions to influence the ink sprayed on the flat support 11, so as to warrant a rapid drying-out of the same.

The particular arrangement of the lamps UV 20 and 21, which are laterally attached to the printing heads 12, allows the freshly sprayed ink to dry, both when printing toward the right or toward the left.

The use of the lamps UV 20 and 21 allows reaching a very high temperature, which may attain and exceed 700° C., while the presence of the flexible tubes 24 and 25 allows drawing cold air from the fans 26 and 27, so as to avoid any overheating of the components of the machine 10.

The lower part of the two box-like bodies 21 and 22 may be opened and closed by the mechanism shown in the FIGS.

2–3, and in particular by the pivoting walls 33 and 34, whenever the light of the lamps UV 20 and 21 needs to be screened off with respect to the flat printing support 11.

The above description clarifies the characteristics as well as the advantages of the machine for printing on flat supports that is the object of this invention.

In the first place, the printing machine does not require a special type of paper as a printing support, but is capable of printing on any support.

Particular examples of said supports, but not limitative thereof, that can be utilized are: normal paper, PVC, wood, aluminum, etc., with the proviso that the machine of the invention can print on any flat support.

This fact is especially relevant, as it demonstrates the great versatility of use of the printing machine of this invention.

In the second place, the radiation of the UV lamps allows a fast drying of the ink, which results in a high printing quality.

Finally, since the invention allows to avoid the use of special paper, it avoids the high costs of operation of the traditional machines.

It is finally evident that numerous variants may be applied to the machine for printing on flat supports, as an object of this invention, without thereby abandoning the innovative principles inherent in the inventive idea.

In the practical application of the invention, the materials, shapes and dimensions of the details described above may be of any kind, depending on the requirements, and may be substituted by others of a technically equivalent type.

What is claimed is:

1. A machine (10) for printing on flat supports (11), equipped with one or more printing heads (12) fed by respective ink reservoirs (13), wherein said one or more printing heads (12) are supported by equipment (14) arranged in a mobile manner in at least two perpendicular directions, wherein said one or more printing heads (12) are associated with at least two ultraviolet lamps (UV) (20, 21), which are also made mobile by said equipment (14), wherein said UV lamps (20, 21) are arranged on the side of the one or more printing heads (12), wherein said UV lamps (20, 21) are contained within box-like bodies (22, 23), respectively, which open or close in their lower portions, wherein each of said box-like bodies (22, 23) is equipped with pivoting walls (33, 34) connected by levers (31, 32) to gears (28, 29) actuated by double racks (30), wherein said box-like bodies (22, 23) are connected to flexible tubes (24, 25) receiving air from fans (26, 27), wherein the group constituted of said UV lamps (20, 21) and of said box-like bodies (22, 23) as well as of said flexible tubes (24, 25) and said fans (26, 27) is firmly attached to said equipment (14) and moves together with the same.

2. A machine (10) according to claim 1, characterized in that the mentioned mobile equipment (14) is attached to an L-shaped support (15), which may in turn slide along a first straight rail (16).

3. A machine (10) according to claim 2, characterized in that said L-shaped support (15) is attached to a control panel (18) connected to said machine (10) by a plastic chain (19) containing the electric connecting cables.

4. A machine (10) according to claim 2, characterized in that said first rail (16) rests, in a gliding manner, on a pair of guides (17).

* * * * *